United States Patent [19]

Haag et al.

[11] 4,101,116

[45] Jul. 18, 1978

[54] APPARATUS FOR MIXING GRANULATED AND/OR PULVEROUS MATERIALS

[75] Inventors: Franz Haag, Isny; Paul Bongartz, Isny-Kleinhaslach, both of Fed. Rep. of Germany

[73] Assignee: MOTAN Gesellschaft mit beschränkter Haftung, Isny, Fed. Rep. of Germany

[21] Appl. No.: 726,620

[22] Filed: Sep. 27, 1976

[30] Foreign Application Priority Data

Oct. 8, 1975 [DE] Fed. Rep. of Germany ..... 2545078

[51] Int. Cl.[2] ..... B01F 7/00; B01F 15/02

[52] U.S. Cl. ..... 366/142; 366/160; 366/266

[58] Field of Search ..... 259/21, 22, 102, 103, 259/40, 41, 5, 6, 7

[56] References Cited

U.S. PATENT DOCUMENTS

| | | | |
|---|---|---|---|
| 2,840,357 | 6/1958 | Nauta | 259/21 |
| 3,664,096 | 5/1972 | LaJeune | 259/7 |
| 3,775,863 | 12/1973 | Updegrove | 259/40 |
| 3,912,235 | 10/1975 | Janssen | 259/7 |
| 3,937,444 | 2/1976 | Kapp | 259/40 |

FOREIGN PATENT DOCUMENTS

| | | | |
|---|---|---|---|
| 221,073 | 5/1962 | Austria | 259/103 |
| 784,469 | 10/1957 | United Kingdom | 259/40 |

*Primary Examiner*—Edward J. McCarthy
*Attorney, Agent, or Firm*—Walter Becker

[57] ABSTRACT

An apparatus for mixing granulated and/or pulverous materials, such as synthetic materials, dye stuffs, and the like. A housing defines a mixing chamber in which is arranged a mixing device. At least a portion of the peripheral area of the mixing device, while forming a gap, borders a surface which is inclined relative to a horizontal plane. The width of the gap is adjusted so that when the mixing device is turned, the material to be mixed is conveyed along the gap against the force of gravity.

12 Claims, 8 Drawing Figures

APPARATUS FOR MIXING GRANULATED AND/OR PULVEROUS MATERIALS

The present invention relates to an apparatus for mixing granulated and/or pulverous materials, such as synthetic materials, dye stuffs, and the like, according to which a housing defines a mixing chamber in which is arranged a mixing tool or device. At least a portion of the peripheral area of the mixing device, while forming a gap, borders a surface which is inclined relative to a horizontal plane. The width of the gap is adjusted so that when the mixing device is turned, the material to be mixed is conveyed along the gap against the force of gravity.

Apparatus are known which have a funnel-shaped housing closed off by a lid. The top of the housing is provided with supply openings for the material to be mixed, and the bottom is provided with an outlet which may be closed. A mixing tool or device, for example a worm gear, is arranged within the housing. The mixing device is connected to an operating or driving arrangement mounted outside the housing. However, the mixture which may be achieved with such an apparatus is not satisfactory.

It is an object of the present invention to provide a mixing apparatus which, without significant additional structural expenditures, will yield a substantially better mixture of the materials supplied thereto.

This object and other objects and advantages of the invention will appear more clearly from the following specification in connection with the accompanying drawings in which.

Figure 3:
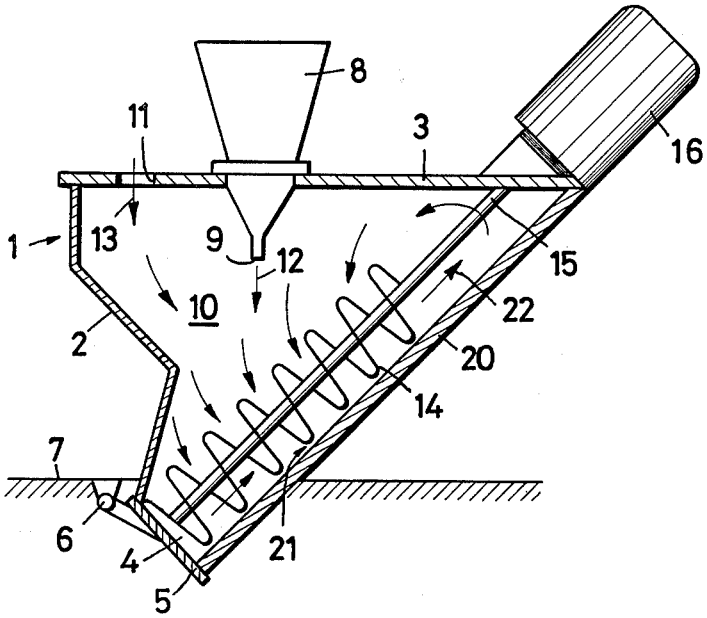
FIG. 3 is a diagrammatic section through another specific embodiment of the mixing apparatus according to the present invention.
Figure 3A:
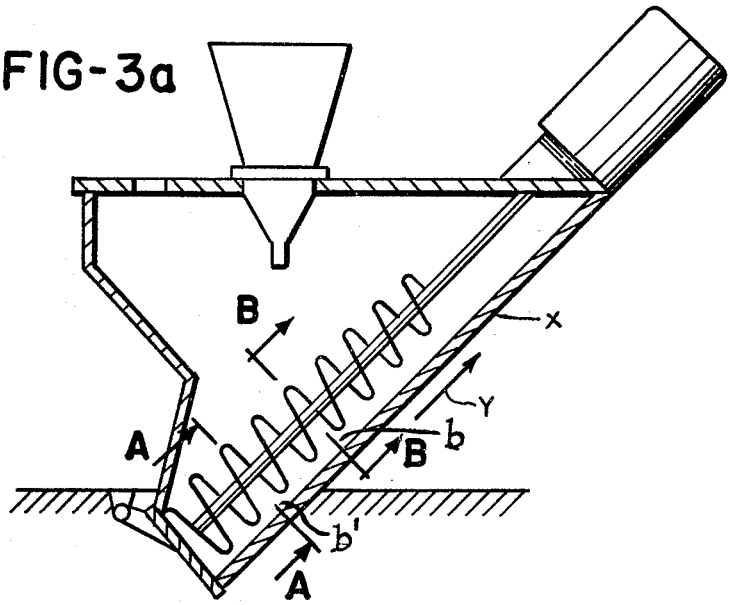

FIG. 3*a* is a diagrammatic section through a further embodiment of the mixing apparatus according to the present invention.

FIG. 3A is a fragmentary cross sectional view taken along line A—A in FIG. 3*a*.

Figure 3B:
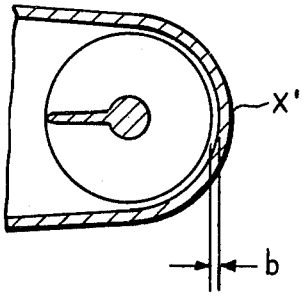
Figure 3A:
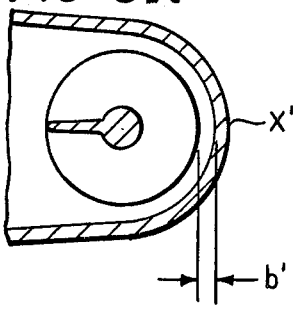

FIG. 3B is a fragmentary cross sectional view taken along line B—B in FIG. 3*a*.

Figure 4:
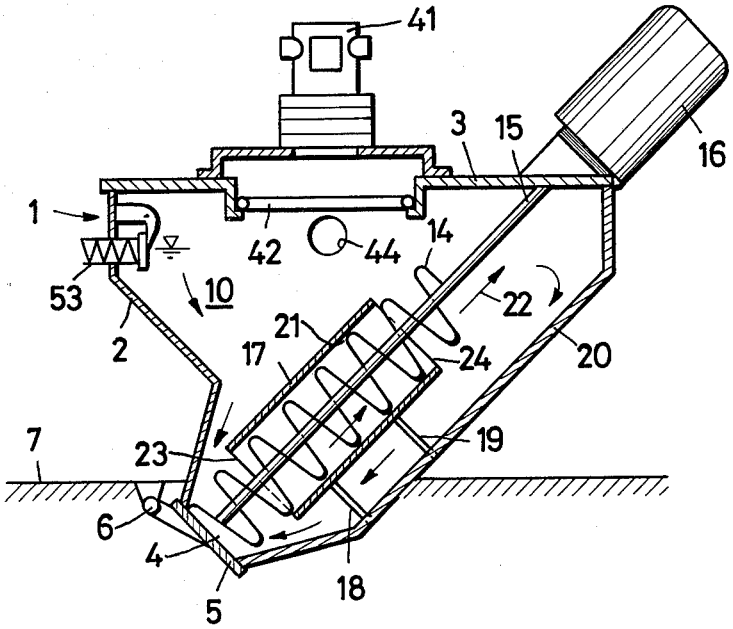

FIG. 4 is a section through yet another specific embodiment of the mixing apparatus according to the present invention.

Figure 5:
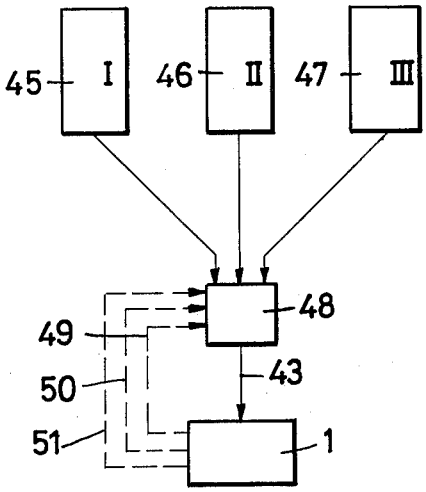

FIG. 5 shows a block diagram of an arrangement for mixing three different materials, using the mixing apparatus of FIG. 4.

The mixing apparatus according to the present invention is characterized primarily by creating a flow of material against the force of gravity from the outlet to the supply opening, resulting in an essentially complete intermixture of the supplied materials.

Figure 1:
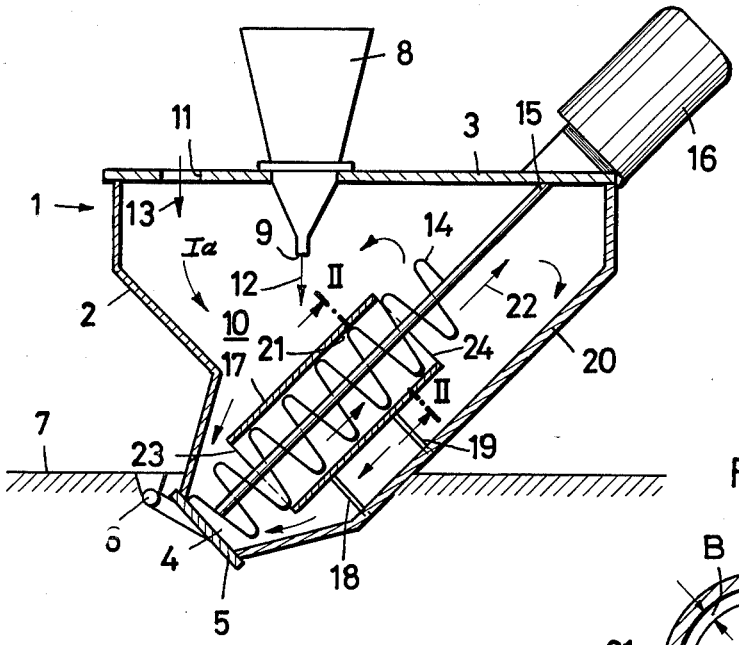
FIG. 1 is a diagrammatic section through one specific embodiment of the mixing apparatus according to the present invention.

Referring now to the drawings in detail, the mixing apparatus of FIG. 1 has a housing 2 whose top is closed off with a lid or top 3. As shown, the housing 2 whose top is closed off with a lid narrows towards the bottom to a discharge opening or outlet 4 which may be closed by a cover 5 which is hinged or pivoted on a hinge 6. The hinge 6 is mounted on a surface 7 which is only shown schematically. The surface 7 may also be the outside of the housing 2.

A conveying device or funnel 8 is supported by the lid 3. The aperture 9 of the conveying device 8 extends into the mixing chamber 10 which is defined by the housing 2, the lid 3, and the cover 5. The conveying device 8 serves, for example, for conveying a first material into the mixing chamber 10 in the direction of the arrow 12. This Material I may be granulated synthetic material and granulated regenerated synthetic material in a specific weight or volume ratio of, for example, 10:1. In addition to the supply opening which goes through the conveying device 8 and is not further shown, a further supply opening 11 is provided in the lid 3. A second material (Material Ia, for example pulverous dye) is introduced into the mixing chamber 10 in the direction of the arrow 13 through this supply opening 11.

Figure 2:
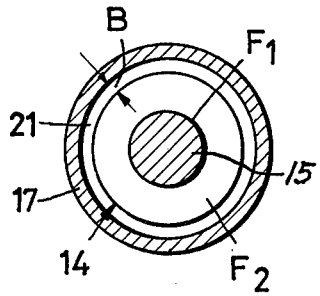
FIG. 2 is a fragmentary cross section taken along the line II — II of FIG. 1.

A mixing tool or device 14 is arranged within the mixing chamber 10. The lengthwise axis of the mixing device 14 is inclined relative to the horizontal surface 7. The lengthwise axis of the mixing device 14 expediently extends in parallel spaced relationship to a side wall 20 of the housing 2. The mixing device 14 may, as shown for example, be a worm gear or endless screw. In this connection, as shown in FIG. 2, the ratio of the cross-sectional area $F_1$ of the worm gear core 15 to the outer cross-sectional area $F_2$ (the sum of the cross-sectional areas of a spiral of the worm gear and of its core) is at least 1:2 (FIG. 2). The mixing device 14 has its free end opposite the cover 5, while its opposite end passes through the lid 3 and is frictionally connected to a driving device 16 which may be mounted on the lid 3.

Pursuant to the present invention, a portion of the operative length of the mixing device 14 is surrounded by a hollow cylindrical body 17 which is mounted on supports 18, 19 in spaced relationship to the inner surface of the side wall 20. As shown in FIG. 2, a gap 21 extends or exists between the inner surface of the hollow cylindrical body 17 and the peripheral surface or area of the mixing device 14. The width B of the gap 21 is such that when the mixing device 14 is turned, the material to be mixed, which is in the mixing chamber 10, is conveyed along the gap 21 in the direction of the arrow 22, that is, against the force of gravity. The width B of the gap 21 ranges, for example, from 0.5 to 3 mm. The flow of the material to be mixed, designated by the arrow 22, reverses in the area of the lid 3 and now proceeds past the outer surfaces of the hollow cylindrical body 17 toward the cover 5. As long as the cover 5 is closed, the material to be mixed which collects by the cover 5 is again picked up by the mixing device 14 and conveyed upwardly in the direction of the arrow 22. Already an intimate mixture is initiated in the gap 21 by means of a secondary movement. In this manner, a turbulent flow of material to be mixed is achieved in the mixing chamber 10, whereby the materials supplied through the conveying device 8 and the supply opening 11 are intimately intermixed.

It is advantageous to have the materials, which are introduced into the mixing chamber 10 in the direction of arrows 12, 13, fall first of all upon the outer surfaces of the hollow cylindrical body 17 and, due to the inclined construction of the latter, slide downwardly toward the cover 5. To this end, the aperture 9 of the conveying device 8 is so positioned that its vertical extension in the direction of the arrow 12 encounters the hollow cylindrical body 17 between the ends 23 and 24.

A second specific embodiment of the present invention is shown in FIG. 3. Those portions which correspond to portions of FIG. 1 have the same reference numerals. The distinction between FIG. 1 and FIG. 3 is that the mixing device 14 of FIG. 3 is not surrounded by a hollow cylindrical body but rather directly borders the inclined surface 20 of the housing 2 while forming a gap 21. In this way, the mixing device 14 conveys the material to be mixed upwardly through the gap 21 in the direction of the arrow 22, while the material to be mixed flows downwards toward the cover 5 upon that peripheral area of the mixing device 14 opposite the gap 21. In this matter a turbulent flow of the material to be mixed is also formed within the mixing chamber 10 thereby assuring a good intermixture. However, in order to form the same degree of intermixture, the specific embodiment of FIG. 3 requires a somewhat longer period of time than that of FIG. 1. the mixing device of FIG. 3 is better suited for obtaining the same rotation of the material than is the mixing device of FIG. 1. Yet the construction and over-all size of the embodiment of FIG. 3 is smaller than that of FIG. 1.

For the specific embodiments of both FIGS. 1 and 3, the gap 21 may have either a constant width B or may narrow in the direction of the arrow in FIG. 3*a*, *x'* and *b'* in FIG. 3A as well as *x'* and *b* in FIG. 3B. Such a narrowing or tapering of the gap width has the advantage that the flow velocity near the end of the gap (that is, in the case of FIG. 1, near the end face 24 of the hollow cylindrical body 17) greatly increases, whereby the flow of the material to be mixed is maintained considerably beyond the end of the gap in the direction of the arrow 22.

The lid 3, along with the driving device 16 supported thereby and the mixing device 14 connected thereto, may be removed, permitting easy cleaning of the housing 2 and of the mixing device 14.

A third yet further simplified specific embodiment of the mixing device according to the present invention is illustrated in FIG. 4. Again, those portions which correspond to portions of FIG. 1 have the same reference numbers. A suction fan 41 is mounted on the lid 3 of the housing 2. The suction fan 41 sucks air out of the mixing chamber 10 through an air filter 42, creating a partial vacuum in the mixing chamber 10. A conduit 43 (FIG. 5) discharges into the mixing chamber 10 through a supply opening 44. The conduit 43, by means of a controllable correcting element 48, such as a valve, may be connected with one of several, for example three, vessels 45, 46, 47 (FIG. 5) for different materials I, II or III. By means of the partial vacuum in the mixing chamber 10, and according to the setting of the control or correcting element 48, material I, II, or III is conveyed from the respective vessel 45, 46, or 47 into the mixing chamber 10. The correcting element 48 is controllable by a plurality, for instance three, fill level indicators of the mixing apparatus 1 by means of respectively separated control lines 49, 50 and 51 shown by dash lines in FIG. 5. The fill level indicators, with only the uppermost fill level indicator 53 being shown, are mounted one on top of another in the side wall of the housing 2 and are respectively associated with the different materials I, II or III. Instead of only one fill level indicator per material, a plurality of fill level indicators may, of course, also be mounted on the same surface.

The mixing apparatus of FIG. 4 operates as follows. When the mixing apparatus 1 is empty and the correcting element 48 is appropriately set, the suction fan 41 draws material I out of the vessel 45 until the lowermost fill level indicator, which is associated with the vessel 45, is activated and cuts off the suction fan 41 as well as adjusts the correcting element 48 in such a way that the vessel 46 is now connected with the conduit 43. After the resulting change-over of the correcting or control element 48, material II is conveyed out of the vessel 46 into the mixing chamber 10 until the next fill level indicator is activated and cuts off the suction fan 41 as well as adjusts the control element 48 so as to connect the vessel 47 with the conduit 43. Subsequently, material III is conveyed out of the vessel 47 into the mixing chamber 10 until the uppermost fill level indicator 53 is activated, again cutting off the suction fan 41 as well as adjusting the control element 48 to its starting position. Subsequently, by starting the driving device 16, the three materials I, II and III are mixed pursuant to the previously described manner.

It is, of course, to be understood that the present invention is by no means limited to the specific showing in the drawings but also comprises any modifications within the scope of the appended claims.

What we claim is:

1. An apparatus for mixing granulated and pulverous materials including synthetic materials and dye stuff which comprises: a housing defining a mixing chamber for receiving material to be mixed, said housing comprising wall means inclined in normal position of said apparatus relative to a horizontal plane, said housing also having means for introducing said material to be mixed into said mixing chamber, and also having outlet means for releasing intermixed materials from said mixing chamber, mixing means rotatably arranged within said housing for cooperation with at least a portion of said wall means so as to form a gap therewith for conveying said material to be mixed along said gap against the force of gravity in response to the rotation of said mixing means in the desired mixing direction, said inclined wall means including a hollow cylindrical body arranged within said housing and at least partially surrounding the operative portion of said mixing means, a portion of said inner surface of said hollow cylindrical body defining a portion of said gap.

2. An apparatus according to claim 1, in which said inclined wall means include at least two oppositely inclined side walls of said housing, and in which the inner surface of one of said inclined side walls defines a portion of said gap.

3. An apparatus according to claim 1, in which the width of said gap is substantially uniform.

4. An apparatus according to claim 1, in which the width of said gap narrows in a direction opposite to the direction of action of gravity.

5. An apparatus according to claim 1, in which the lowermost section of said housing in the vicinity of the free end of said mixing means narrows and forms said outlet means.

6. An apparatus according to claim 1, in which said rotatable mixing means is a worm gear, the ratio of the cross section of the core of said worm gear to the entire cross section of said worm gear being at least 1:2.

7. An apparatus according to claim 1, in which said inlet means includes at least one conveying device having an aperture extending into said mixing chamber.

8. An apparatus according to claim 1, in which said housing has a removable lid supporting said inlet means.

9. An apparatus according to claim 8, which includes driving means supported by said lid for driving said rotatable mixing means.

10. An apparatus according to claim 1, which includes a volumetric metering device forming part of said inlet means for conveying different materials into said mixing chamber and fill level indicator means respectively provided for each material successively conveyed into said mixing chamber, said fill level indicator means being arranged one above another for the respective materials to be conveyed into said mixing chamber.

11. An apparatus according to claim 1, in which the axes of said mixing means and said hollow cylindrical body extend substantially parallel to one of said inclined side walls of said housing.

12. An apparatus according to claim 1, in which said inlet means includes an aperture located above a portion of said cylindrical body so that material to be mixed and conveyed through said aperture into said mixing chamber will fall upon a portion of the outer surface of said hollow cylindrical body.

* * * * *